US005505255A

United States Patent [19]

Viessmann

[11] Patent Number: 5,505,255

[45] Date of Patent: Apr. 9, 1996

[54] HEAT EXCHANGER FOR ARRANGEMENT BEHIND THE COMBUSTION CHAMBER OF A HEATING BOILER

[76] Inventor: Hans Viessmann, Im Hain, S-3559 Battenberg, Germany

[21] Appl. No.: 85,416

[22] Filed: Jun. 30, 1993

[30] Foreign Application Priority Data

Jul. 1, 1992 [DE] Germany ..... 42 21 528.5

[51] Int. Cl.[6] ..... F28D 1/03

[52] U.S. Cl. ..... 165/164; 165/163

[58] Field of Search ..... 165/163, 164

[56] References Cited

U.S. PATENT DOCUMENTS

| | | | |
|---|---|---|---|
| 1,945,287 | 1/1934 | Monroe | 165/163 X |
| 2,085,256 | 6/1937 | Feldt | 122/134 |
| 2,129,300 | 9/1938 | Bichowsky | 165/163 |
| 2,488,549 | 11/1949 | MacCracken | 165/163 X |
| 2,663,549 | 12/1953 | Otten | 165/163 |
| 3,921,713 | 11/1975 | Schnitzer et al. | 165/167 |
| 3,972,370 | 8/1976 | Malaval | 165/163 |

FOREIGN PATENT DOCUMENTS

| | | | |
|---|---|---|---|
| 0123995 | 4/1984 | European Pat. Off. | F24H 1/28 |
| 95873 | 5/1897 | Germany . | |
| 101612 | 4/1898 | Germany . | |
| 288039 | 11/1914 | Germany . | |
| 925721 | 3/1955 | Germany . | |
| 1753242 | 7/1971 | Germany . | |
| 3014506 | 10/1985 | Germany | F28D 9/04 |

*Primary Examiner*—Allen J. Flanigan

*Attorney, Agent, or Firm*—Webb Ziesenheim Bruening Logsdon Orkin & Hanson

[57] ABSTRACT

The invention is concerned with a heat-exchanger for arrangement behind the combustion chamber of a heating boiler. The heat-exchanger comprises water-carrying and gas-carrying interior chambers separated from one another by walls extending in parallel and being spirally coiled about a filling member and sealed against one another by bent edges. In order to so form a preferred form of embodiment of a heat-exchanger of this type so that the participating components, considering the coiling process, can be thinly dimensioned and nevertheless insure a pressure-stable final condition, thereby foregoing separate spacers actually not forming part of the heat-exchanger and thereby preventing or substantially preventing during coiling into a spiral the edges to be joined by welding from forming wave-type warpings and the wall faces from deforming, the heat-exchanger according to the invention is designed such that the wall which relative to the coil axis is the inner wall, at the top and at the bottom, includes externally bent edges having a width at most corresponding to the width of the water-carrying passage and the outer wall includes inwardly bent edges having a width corresponding, at most, to half the width (B), which edges overlap the edges of the inner wall or are in alignment therewith and are connected thereto in fluid-tight manner. Corrugated structures of both walls protruding into the gas-carrying passage open at the inlet and outlet sides, are arranged at a distance (D) from the edges in the walls extending substantially in parallel to the coil axis in a mutally supporting manner. The water-carrying passage is sealed at both ends of the spiral except for the forward and return connection openings.

19 Claims, 5 Drawing Sheets

Fig.2A
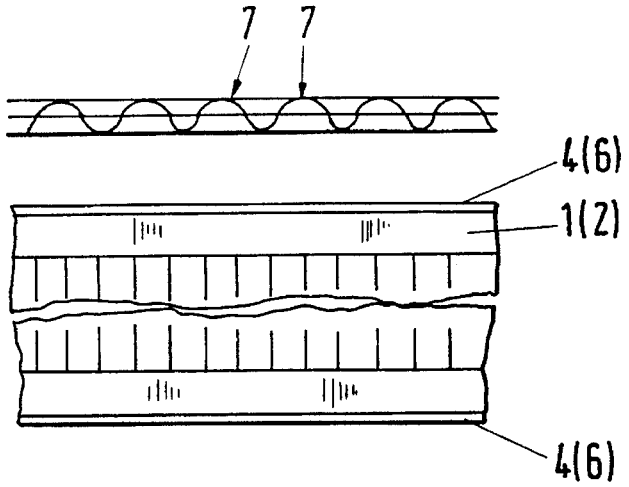
Fig.3A
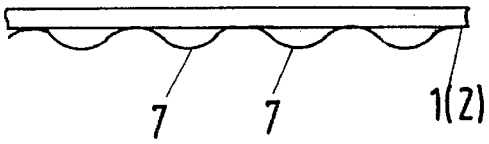
Fig8
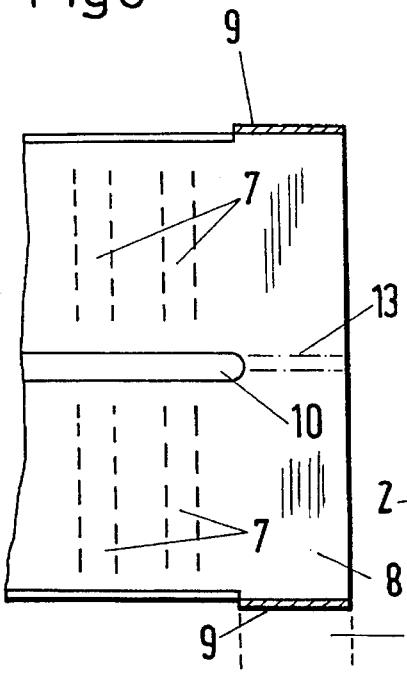
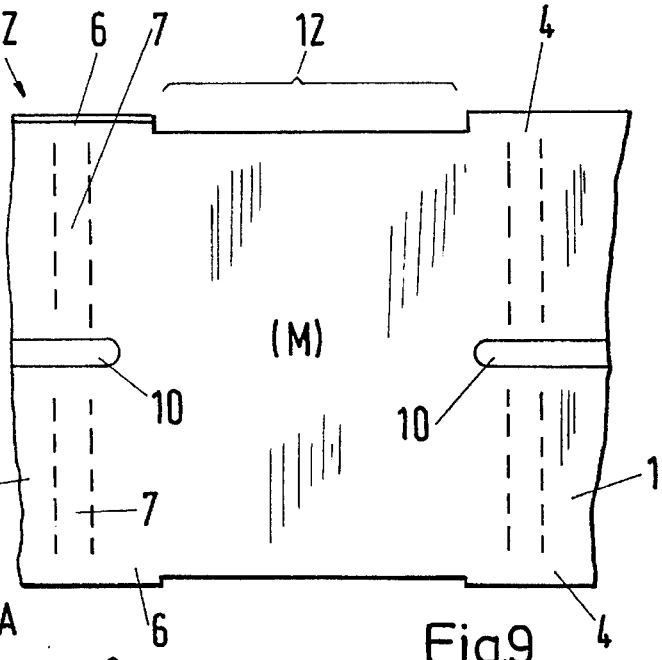
Fig.9
Fig.9A
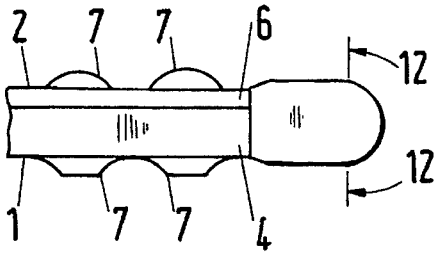

HEAT EXCHANGER FOR ARRANGEMENT BEHIND THE COMBUSTION CHAMBER OF A HEATING BOILER

BACKGROUND OF THE INVENTION

1. Field of the Invention

My invention is concerned with a heat-exchanger for arrangement behind the combustion chamber of a heating boiler, and is further concerned with a method of manufacturing a heat-exchanger of this type.

2. Description of the Prior Art

Heat-exchangers of this type which are, however, neither intended nor suitable for use as heat-exchangers to be arranged behind the combustion chamber of heating boilers, have been taught, for example, by DE-A-925 721 and DE-A-3 014 506. The heat-exchangers according thereto are not of the type intended for arrangement behind the combustion chamber because the combustion chamber as such is contained therein and because the heating gases do not flow therethrough in the axial direction but rather in a spiral way. The same applies to a heat-exchanger of the type as described by EP-A-0 123 995. Reference is made to the verified state of art as evinced through the following literature references: U.S. Pat. No. 2 085 256; DE-A-95873; DE-A-288 039; DE-A-101 612 and DE-A-1 753 242. Although spirally coiled heat-exchangers of this type are advantageous as regards flow pattern, compact design and heat exchange, it has been found, quite amazingly, that such heat-exchangers do not seem to have introduced themselves as heat-exchangers integrated into the heating boiler casing behind the combustion chamber. Presumably, this is because it is extremely difficult, on the one hand, to close the narrow sides of the resultant channels of spiral configuration for the fluids participating in the heat exchange and, on the other hand, to spirally coil the participating sheet metals while maintaining the required distance from one another, i.e. without deformation.

Suggestions to achieve this are conveyed by a heating boiler according to DE-A-1 753 242 which, however, has also proved to be impracticable, or by a system according to the aforementioned DE-PS 925 721 which, however, is not suitable to be used as a heat-exchanger for arrangement behind the combustion chamber of a heating boiler because no open in-flow of the heating gases nor a straightforward flow thereof in the axial direction is permitted. Moreover, in this type of heat-exchanger exposed sheet metal edges arise on the in-flow side which would be subject to a high thermal strain. In addition, further spacers must be provided between the channels which, apparently, were unavoidable to enable a structure of this type to be spirally coiled. In addition, the bent edges directed towards the coil axis and predetermining the full width of the individual channels, during spiral coiling, form undulatory warpings because they face inwardly with the full width thereof so that welding difficulties are inevitably involved. Accordingly, the applicability of such spirally coiled heat-exchangers for arrangement behind the combustion chamber of heating boilers, due to the required and largely mechanical series production, stands and falls with an easy-to-manufacture design.

SUMMARY OF THE INVENTION

Starting from the prior art principle of a spirally coiled heat-exchanger it is, therefore, an object of the present invention to improve the heat-exchanger of the beforementioned type such that the participating components, i.e.

substantially the two walls, under consideration of the coiling process, can be thinly dimensioned while at the same time safeguarding an adequate pressure-stability in the final condition. This foregoes separate spacers not forming part of the heat exchanger and prevents or substantially prevents, during coiling, the edges to be joined by welding from forming undulatory warpings and the wall faces from deforming.

My invention provides further a novel method of making my improved heat-exchanger which is economically carried into effect and which affords a strong construction that permits free expansion of the walls just before welding without injurious effects. The above objects are accomplished, in the practice of my invention, with a heat-exchanger comprising water-carrying and gas-carrying interior chambers or passages which are separated from one another by walls extending in parallel and being spirally wound about a filling body and which are closed vis-á-vis one another by bent edges. In accordance with the invention, the wall which relative to the coil axis is the inner wall, at the top and bottom includes externally bent edges having a width corresponding at most to the width of the water-carrying passage whereas the outer wall includes inwardly bent edges overlapping the edges of the inner wall or being in alignment therewith and being connected in fluid-tight manner therewith. Corrugated structures of both walls protrude into the gas-carrying interior flown-through in a direction parallel to the coil axis, and are open at the in-flow and off-flow sides and are oriented in the flow direction being designed to be arranged at a distance from the edges in the walls in a manner supporting one another. The water-carrying passage is closed at both ends of the spiral except for the forward and return connection openings.

The design according to my invention is based on a special and new method of manufacture in which the welding of the two wall sections is effected during coiling and immediately after joining and after completion of the differential bending. The two wall sections, hence, can still independently—but already in a form jointed together—follow the spiral bending which for the two portions takes place in radially different spiral planes. It is only immediately after bending that they are welded together. In this respect it should be noted that the language "after bending" does not mean the completion of the total spiral coiling but rather respectively only the "differential" bending processes throughout the spiral coiling. To take into account a series production and a continuous manufacture it is advantageous to proceed as suggested in claim 9, with the next process claim setting forth an improvement having an advantageous effect on the heat-exchanger as such inasmuch as also the externally bent edge of the inner wall in the radial extension can be kept shorter because the spacing function is assumed by the spacer extending to the weld. It is important for the bending width of the two participating edges to remain weldable either in the overlapped position or in the aligning position, with the inwardly facing bent edge being held as small as possible because, during bending, it is subjected to a stronger undulatory deformation than the outwardly facing edge.

The axially oriented corrugated structures protruding into the gas-carrying passage have a three-fold function: firstly, they contribute to the pressure stability of the walls, secondly, they increase the heat-exchanger face and, thirdly, they form, for the coiling process, the spacers on the gas side. The language "extending essentially in parallel to the coiling axis" conveys that the corrugated structures, in joined-together condition, weakly cross thereby being able to support point-wise. Most important in this respect is the fact that the corrugated structures do not at the same time seize, in part, the bent edges as this would result in substantially predetermined bending points which are expressly to be avoided. In the event of a greater height of the spirally coiled heat-exchanger and, optionally, also under consideration of a special flow pattern on the water side, an advantageous embodiment will reside in that the inner wall is provided with at least one corrugated structure extending in a direction perpendicular to the coil axis. During spiral coiling, the central area of the outer wall exposed to the danger of being drawn in is supported and is held at a precise distance, and, on the other hand, the flow channel on the water side is thereby subdivided so that with the two channels connected in series, the water flows through the heat-exchanger in counter-flow or in parallel flow depending on the arrangement of the forward and return connections.

The water-carrying channel simply remains open at both ends and, depending on the design of the heating boiler, is suitably connected, in liquid-tight manner to forward and return chambers provided with corresponding openings. Coiling is, of course, not effected from the center of the spiral directly, i.e. the center of the spiral is formed by a correspondingly sized filling member which, in the aforementioned case, forms the return chamber to which is connected the spiral and the water-carrying channel, respectively, with the inner end thereof. An alternative form of embodiment in which the filling member is not hollow and is made of a suitable thermally loadable material is conveyed by claim 3. This form of embodiment yet to be described in greater detail can, however, not be made of strips continuously drawn from coils.

BRIEF DESCRIPTION OF THE DRAWINGS

The heat-exchanger of my invention and the method for making it will now be described in more detail with reference to preferred forms of embodiments thereof, taken in conjunction with the accompanying, partially diagrammatic drawings, wherein

FIGS. 2A and 3A are illustrations of different types of wave structures (shown in FIG. 2A in side and plan views);

FIG. 8 is a vertical sectional view of the inverted end of the heat exchanger according to FIG. 7;

FIG. 9 is a view of the flatted bending area for forming the inverted end according to FIG. 8;

FIG. 9A is a plan view of the bending area; and

BRIEF DESCRIPTION OF THE PREFERRED EMBODIMENTS

Figure 1:
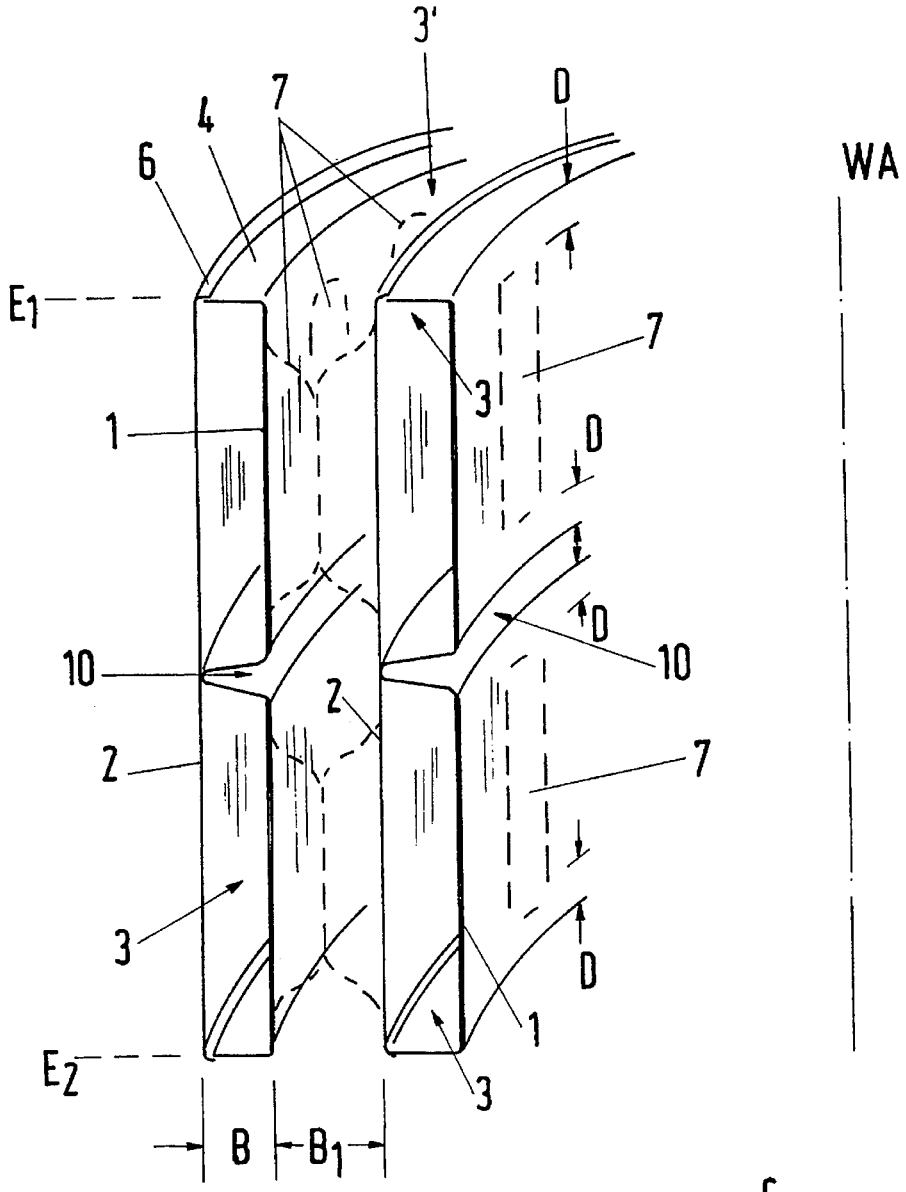
FIG. 1 is a perspective view of two parallel coil strip portions of the heat exchanger.

The heat-exchanger conventionally comprises water-carrying and gas-carrying passages 3,3' which are separate from one another and closed against one another by walls 1,2 extending in parallel and being spirally coiled about a filling member 5, and which are closed vis-á-vis one another by bent edges.

In respect of a heat-exchanger for arrangement behind the combustion chamber of a boiler- hereinafter briefly referred to as HEAT-EXCHANGER—it is important according to the invention that the wall 1 which relative to the coil axis WA is the interior wall, at the top and bottom comprises outwardly bent edges 4 of a width corresponding, at most, to the width B of the water-carrying passage 3. The outer wall 2 has inwardly bent edges 6 being, at most, of half the width B, with edges 6 overlapping edges 4 of the inner wall 1 or being in alignment therewith and being connected thereto in liquid-tight manner. Wave-type structures 7 of the two walls 1,2 projecting into the gas-carrying passage 3' open at the in-flow and off-flow sides thereof are designed to be disposed at a distance D from the edges 4,6 in walls 1,2 in a direction substantially parallel to the coiling axis WA in a manner supporting one another, whereas the water-carrying passage 3 at both ends of the spiral is sealed except for the openings provided on the forward and return connections.

Figure 3:
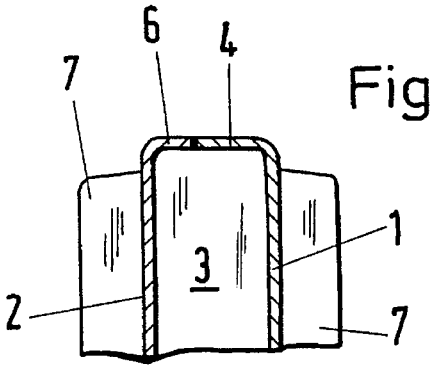
Figure 4:
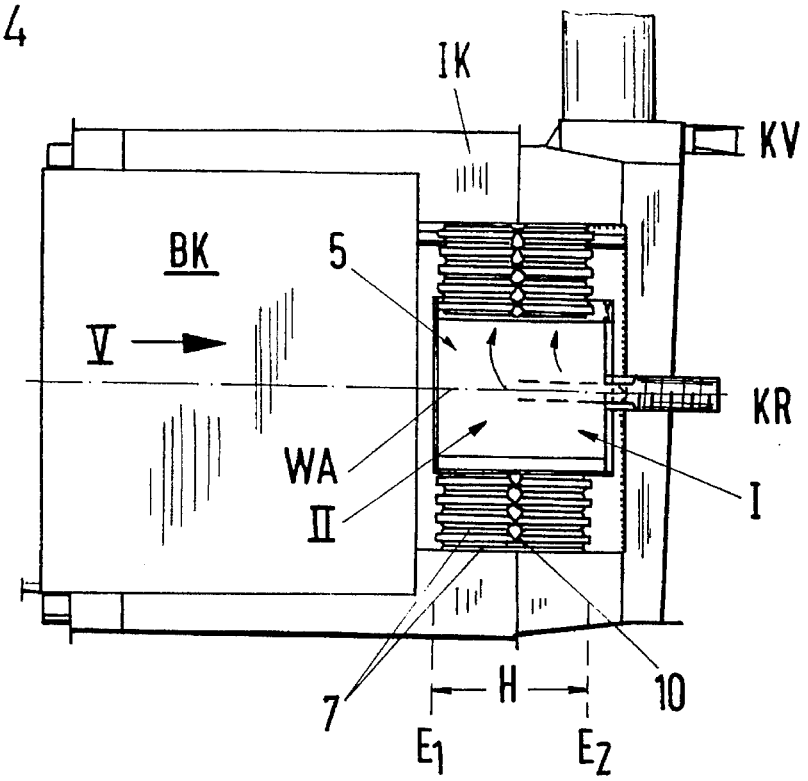
FIG. 4 is a sectional view along line IV—IV in FIG. 5 of the arrangement of the heat-exchanger within a heating boiler.
Figure 5:
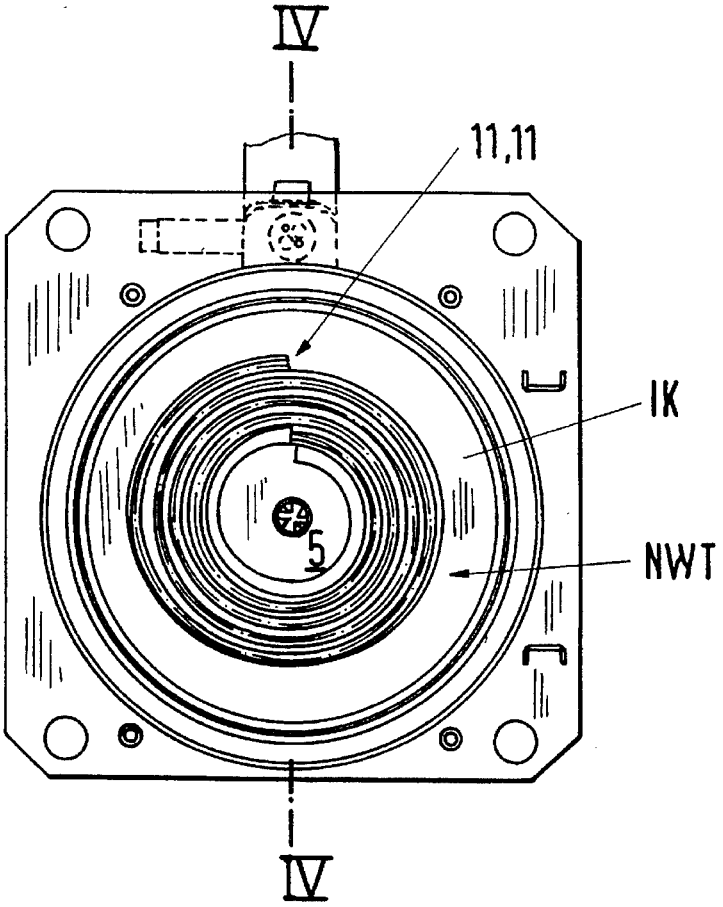
FIG. 5 shows the heating boiler according to FIG. 4 in the direction of arrow V.

A plan view of the heat-exchanger of this type is shown in FIG. 3 which also reveals that the inner coiling end of the spiral does, of course, not start in the center thereof but rather on a filling member 5 which in the form of embodiment according to FIGS. 4,5 is designed as a cavity and forms the return connection. Coiling from the center is not practical as the bending radii would be too small for that purpose. The forms of embodiment according to FIGS. 4,5 are HEAT-EXCHANGERS of a relatively large height H, and under consideration hereof, the inner wall 1 is provided with a central wave-type structure 10 extending in a direction perpendicular to the coil axis WA. The depth of structure 10 corresponds to the width B of the water-carrying passage 3. The corrugated structure 10 (see also FIG. 1) centrally supports the wall 2 and subdivides the water-carrying passage 3 so that two corresponding spiral, parallel flows pass therethrough from the filling member 5 (return connection) to be passed through the two openings 11,11' into the water-carrying interior IK of the heating boiler. The heating gases entering the heat-exchanger from the combustion chamber BK of the heating boiler flow through the gas-carrying passage 3' open at both sides, in a direction parallel to the coil axis.

The two walls 1,2 which, in the forms of embodiment according to FIGS. 4,5 can be drawn as strips from coils prior to their being joined together as shown in FIG. 1 by suitable tools, are provided with wave-type structures 7, optionally with wave-type structures 10 (in the longitudinal direction) and with bent edges 4,6, which can be effected by rolling or embossing the strips.

Figure 2:
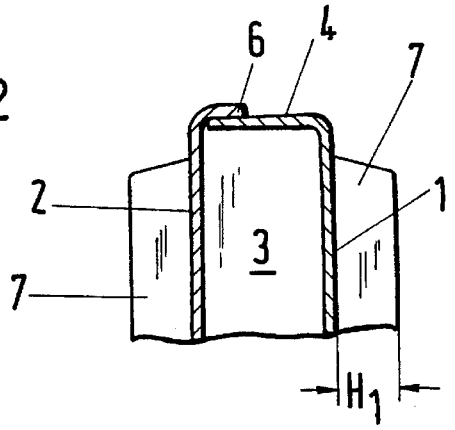
FIGS. 2 and 3 are sectional views of forms of embodiment of bent edges of the coil strip.

The welding of the edges 4,6 which according to FIG. 2 overlap or according to FIG. 3 are in alignment with one another, is effected substantially during the coiling process directly behind the bending point, i.e. after completion of the bending. A previous welding would result in bending a substantially rigid tube of flat rectangular cross-section which would result in tensions, bends and welding cracks. Overlapping of the edges 4,6 in the sense of FIG. 2 will be preferred as easier welding is insured thereby.

The width $B_1$ of the gas-carrying passage 3' is defined by the height $H_1$ of the two wave-shaped structures 7 in pointed contact in walls 1,2 thereby at the same time forming spacers during coiling. The wave-shaped structures 7 can be formed as shown in FIGS. 2A and 3A. In both cases it is of importance that they end at a distance D before edges 4,6 and also before the central wave-shaped structure 10, if any.

Figure 6:
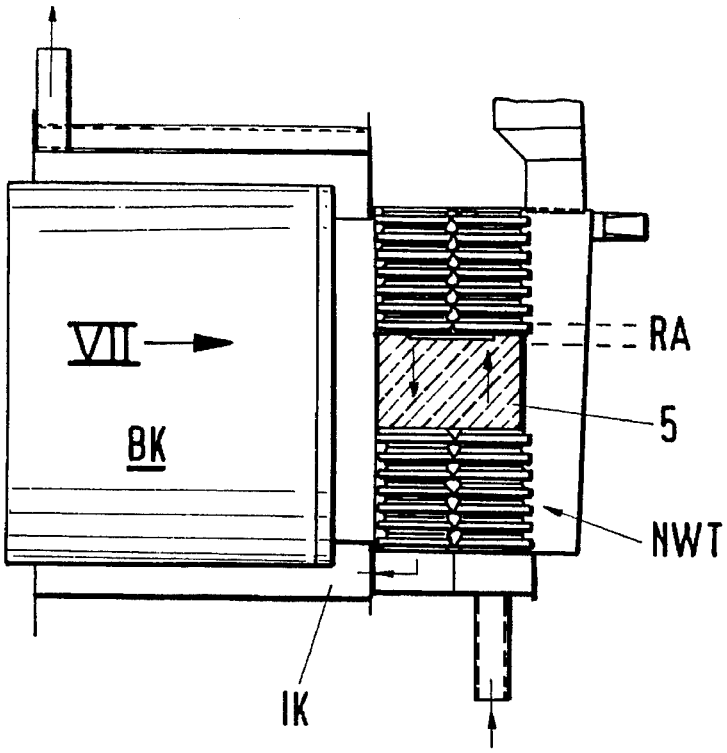
FIG. 6 is a sectional view along line VI—VI in FIG. 7 of the arrangement of an alternative form of embodiment of the heat-exchanger in a heating boiler.
Figure 7:
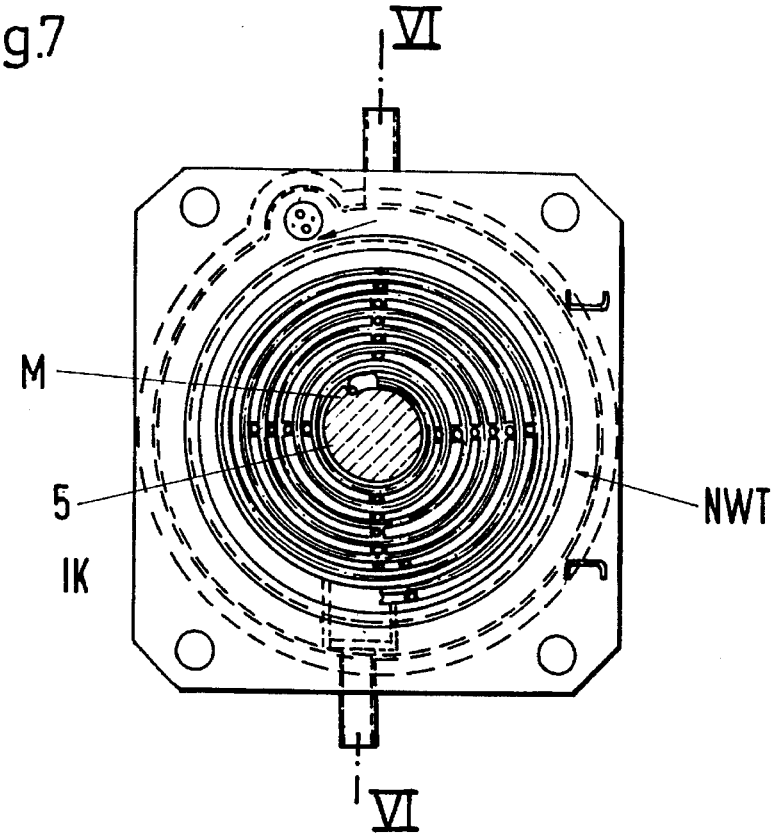
FIG. 7 shows the heating boiler according to FIG. 6 in the direction of arrow VII.

The heat-exchanger according to FIGS. 6 and 7 differs from the afore-described one in that the two walls 1,2 are formed from a strip blank corresponding to the double length of the spiral length, which in the center M thereof, is kept free from bent edges 4,6 and at least from deep wave structures 7, and in that area is bent by 180° . The areas free from edges 4,6, at the top and bottom of the resultant overflow channel 8, extending in parallel to the coil axis WA, are closed by cover faces 9.

In this respect, reference is made to FIGS. 8,9 in which the bending area is designated by numeral 12 and shown again, with reference to FIG. 7, as an enlarged plan view, in FIG. 9A. This structure is then placed, with the overflow channel 8 at the front, into the coil winder and is wound to form a coil as shown in FIG. 7.

In the absence of a central division through a wave structure 10 (for example, in the case of a low height H of the heat-exchanger), the return connection RA as shown in broken lines in FIGS. 6,8 would be directly connected to the overflow connection 8. In the presence of a corrugated structure 10 the introduction of the return conduit is effected externally at the spiral, to pass inwardly to the overflow channel 8 where it reaches the other part of the water-carrying passage 3 to flow from the inside to the outside for passage, in a suitable way, into the water-carrying interior IK of the boiler casing, i.e. in that case the heat-exchanger would be one counter-flowing in parallel.

Apart therefrom, a separating stem 13 could be inserted in the overflow channel 8 as shown in dash-dotted lines in FIG. 8, in alignment with the corrugated structure 10. If both parts of the water-carrying passage are then suitably connected to separate forward and return connections, separate interior chambers are formed, in which case the discharge side part would be connected, for example, to a floor heater the temperature level of which is usually lower. Incidentally, this design can also be realized with the heat-exchanger according to FIGS. 4,5 if the same is provided, as shown, with a corrugated structure 10, in which no separating stem 13 but a corresponding subdivision of the hollow body forming the filling member 5 is required as shown in FIG. 4 in broken lines.

Figure 10:
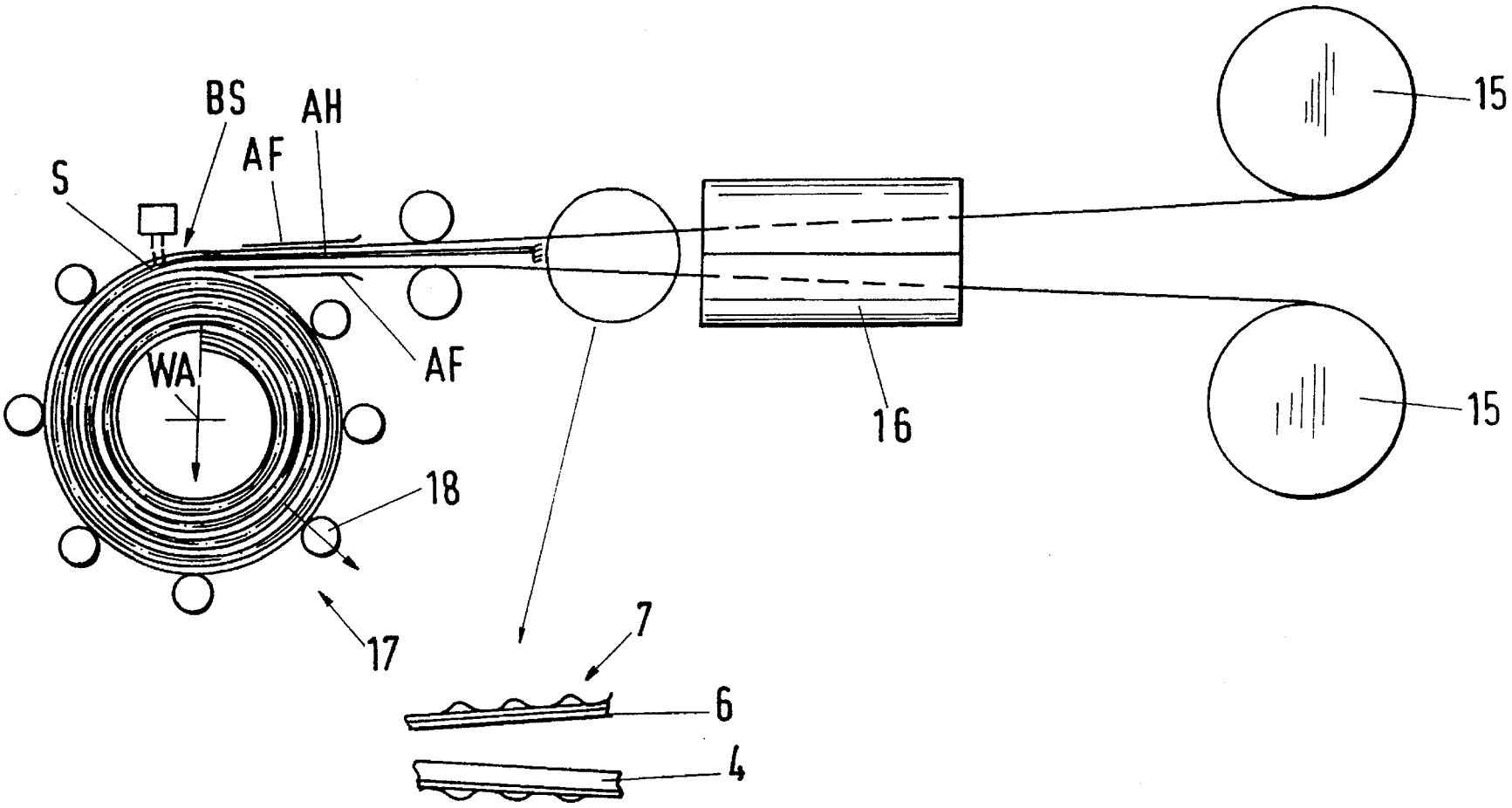
FIG. 10 schematically shows the process pattern for the continuous manufacture of the heat-exchanger.

The manufacture of the heat-exchanger according to FIGS. 4,5, basically, could also be such that the walls 1,2 provided with corrugated structures 7 and bent edges are first detachably joined together, coiled and then welded by a welding device following the spiral path of the edges 4,6 to be welded. In any case, provision would have been made thereby that the edges 4,6 and the walls 1,2, respectively, during coiling, to a certain degree could displace relative to one another. However, it is substantially more advantageous and less time-consuming (which also applies to the forms of embodiment according to FIGS. 6,7) to weld the two walls 1,2 together in liquid-tight manner at the edges 4,6 thereof during spiral coiling, in a bending-differential way, immediately after bending under a continuous radial outward guidance of a coiling means 17, with the two walls 1,2 according to another form of embodiment—in view of the fact that the coil-forming process is anyway more or less continuous—being passed (which, however, only applies to the forms of embodiment according to FIGS. 4,5) as sheet metal strips from coils 15 to a corrugating and edge bending means 16. The corrugated sheet metal strips are passed thereafter to the joining device and to a coiling means 17 arranged immediately therebehind as schematically shown in FIG. 10. If the edges 4,6 to be welded are designed and arranged as shown in FIG. 3, the two walls 1,2 during joining are guided along a spacer AH stationarily held between walls 1,2 and extending to the weld S.

The welding of edges 4,6 extending in planes $E_1$ and $E_2$ between which the "plane spiral" is formed during coiling is, of course, effected simultaneously in both planes $E_1$,$E_2$ at the top and bottom, at the rear and at the front, respectively. The welding means 14 is stationarily arranged behind the bending point BS it being inevitable for the spiral coiling means 17 to be displaceably positioned to be able to take into account the growing diameter of the coil.

The spacer AH projecting between the two incoming sheet metal strips, and the outer guidances AF, insure a precise spacing between the two walls 1,2 which, in particular, applies to the form of embodiment according to FIG. 3. The rollers or drums 18, respectively, of the coiling means 17 are—as shown—arranged therein in a radially displaceable way in accordance with the growing volume of the plane spiral during coiling. Since after completion of the coiling process the plane spiral is already welded and ready for discharge, this way of proceeding is the preferred one. However, it will also be possible to perform the coiling before carrying out the welding while the plane spiral is continually held in the coiling means 17, with the welding means 14 being guided in a correspondingly controlled way. Incidentally, it should be noted that it is especially in the form of embodiments according to FIGS. 4,5 that the two inner ends of the walls 1,2 are first welded to the filling member 5 formed as a hollow body, with the filling member also contained in the coiling means 17 forming the coiling core.

Apart from the afore-described mounting examples according to FIGS. 4 to 7, such a "plane spiral", in the presence of correspondingly designed connections, can, of course, also be used for the passage and heating of process water.

What I claim is:

1. A heat-exchanger for arrangement behind a combustion chamber of a boiler, said heat-exchanger including water-carrying and gas-carrying interior chambers sealed against one another by an inner wall and an outer wall extending in parallel and being spirally coiled about a filling member, the top and bottom of said inner wall including externally bent edges a width of which corresponds to a width of said water-carrying interior chamber, said outer wall including inwardly bent edges of a width corresponding to half said width of said water-carrying interior chamber, said inwardly bent edges of said outer wall overlapping said externally bent edges of said inner wall and said overlapped edges being interconnected in liquid-tight manner, said inner wall and said outer wall including corrugated structures with said corrugated structures of both said walls oriented in a direction of flow protruding into said gas-carrying spiral interior chamber which is open at an inlet side and an outlet side and flowed-through in parallel to the coil axis, with said corrugated structures terminating at a distance before said bent edges of said inner and said outer walls; wherein adjacent corrugated structures arranged oppositely are supported one against the other, and said water-carrying interior chamber of said heat-exchanger is closed on both ends of the spiral except for a forward and a return connection opening.

2. A heat-exchanger according to claim 1, wherein said inner wall is provided with at least one perpendicular corrugated structure extending in a direction perpendicular to said coil axis, with the depth of the said perpendicular corrugated structure corresponding to the width of said water-carrying interior chamber.

3. A heat-exchanger according to claim 1, wherein said inner and said outer walls are formed from a strip blank corresponding in length to a double strip length, with a central area of said blank being kept free from said bent edges and at least from deep corrugated structures and being bent by 180° forming a resultant overflow channel extending in parallel to said coiled axis, wherein the top and bottom of said overflow channel are closed by cover faces.

4. A heat-exchanger according to claim 3, wherein said inner wall is provided with a longitudinal corrugation and a separating stem is arranged in said overflow channel in alignment with said longitudinal corrugation.

5. A heat-exchanger according to claim 3, wherein said inner wall is provided with a longitudinal corrugation and one of said cover faces is formed as a return connection.

6. A heat-exchanger according to claim 1, wherein said filling member is a hollow member forming a return connection.

7. A heat-exchanger according to claim 6, wherein an interior of said filling member is subdivided into at least two return chambers and connected thereto are portions of said water-carrying interior chamber of said heat-exchanger.

8. A heat-exchanger comprising:

an inner wall and an outer wall extending parallel to each other and being spirally coiled about a coil axis so as to surround a filling member, wherein said inner and said outer wall form a water-carrying interior chamber and an adjacent gas-carrying interior chamber;

said inner wall including externally bent edges at a top and bottom surface thereof adjacent inwardly bent edges of said outer wall, with said adjacent bent edges being interconnected in a liquid-tight manner; and said inner wall and said outer wall including corrugated structures aligned parallel to said coil axis which protrude into said gas-carrying interior chamber, with said corrugated structures positioned between said bent edges of said inner wall and said outer wall, wherein adjacent corrugated structures arranged oppositely abut one against the other.

9. The heat-exchanger of claim 8, wherein said adjacent bent edges are in alignment with each other.

10. The heat-exchanger of claim 8, wherein said adjacent bent edges are positioned to overlap.

11. The heat-exchanger according to claim 8, wherein said inner wall is provided with at least one perpendicular corrugated structure extending in a direction perpendicular to said coil axis, with the depth of said perpendicular corrugated structure corresponding to the width of said water-carrying interior chamber.

12. A heat-exchanger according to claim 8, wherein said filling member is a hollow member forming a return connection.

13. A heat-exchanger according to claim 12, wherein the interior of said filling member is subdivided into at least two return chambers and connected thereto are portions of said water-carrying interior chamber of said heat-exchanger.

14. A heat-exchanger according to claim 8, wherein said inner wall and said outer wall are formed from a strip blank, with a central area of said blank being bent by 180° forming a resultant overflow channel extending in parallel to said coil axis.

15. The heat-exchanger according to claim 14, wherein said inner wall is provided with a longitudinal corrugation and a separating stem which is arranged in said overflow channel in alignment with said longitudinal corrugation.

16. The heat-exchanger according to claim 14, wherein said inner wall is provided with a longitudinal corrugation and a cover face in the form of a return connection coupled to said overflow channel.

17. A heat-exchanger comprising:

an inner wall and an outer wall extending parallel to each other and being spirally coiled about a filling member, wherein said inner and said outer wall form a water-carrying interior chamber and an adjacent gas-carrying interior chamber;

said inner wall including externally bent edges at a top and bottom surface thereof adjacent inwardly bent edges of said outer wall, with said adjacent bent edges being interconnected in a liquid-tight manner; and said inner wall and said outer wall including corrugated structures which protrude into said gas-carrying interior chamber, with said corrugated structures positioned between said bent edges of said inner wall and said outer wall, wherein adjacent corrugated structures arranged oppositely are supported one against the other, wherein said inner wall and said outer wall are formed from a strip blank, with a central area of said blank being bent by 180° forming a resultant overflow channel extending in parallel to said coil axis.

18. The heat-exchanger according to claim 17, wherein said inner wall is provided with a longitudinal corrugation and a separating stem which is arranged in said overflow channel in alignment with said longitudinal corrugation.

19. The heat-exchanger according to claim 17, wherein said inner wall is provided with a longitudinal corrugation and a cover face in the form of a return connection coupled to said overflow channel.

* * * * *